United States Patent [19]

Boyle et al.

[11] 3,960,305

[45] June 1, 1976

[54] SLOT VACUUM JET

[75] Inventors: Edward Michael Joseph Boyle, Park Forest, Ill.; Melvin Harry Johnson, Wilmington, Del.

[73] Assignee: E. I. Du Pont de Nemours and Company, Wilmington, Del.

[22] Filed: July 11, 1974

[21] Appl. No.: 487,817

[52] U.S. Cl. ..... 226/95

[51] Int. Cl.[2] ..... B65H 17/32

[58] Field of Search ..... 226/5, 7, 95, 97, 11, 226/91; 28/1.4, 72.12; 15/306 A

[56] References Cited

UNITED STATES PATENTS

| | | | |
|---|---|---|---|
| 2,030,744 | 2/1936 | Clark | 226/95 |
| 2,142,711 | 1/1939 | Birch | 15/306 A |
| 2,753,181 | 7/1956 | Anander | 226/95 |
| 3,297,222 | 1/1967 | McDermott | 226/97 |
| 3,302,237 | 2/1967 | Cope | 226/97 |
| 3,321,121 | 5/1967 | Nyberg | 226/95 |
| 3,526,017 | 9/1970 | Kleimola | 15/308 |

*Primary Examiner*—Richard A. Schacher

[57] ABSTRACT

An improved suction nozzle is comprised of a narrow constant height slot passageway open at one end and communicating at the other end with an expansion chamber which, in turn, is connected to a cylindrical manifold. An orifice in the end of the manifold assists in the development of parallel fluid flow along the manifold axis.

2 Claims, 5 Drawing Figures

SLOT VACUUM JET

BACKGROUND OF THE INVENTION

This invention relates to a suction nozzle for use on a spin-draw-winding machine. More particularly, the invention is for an improved suction nozzle capable of picking up and aspirating away a high-speed threadline. Machines have been described in which the functions of spinning, drawing and winding are all combined in one machine and which operate at very high threadline speeds. In addition to high thread-line speeds, multiple threadlines are usually spun and processed together over a series of rolls on a single machine. From two to eight or more threadlines, constituting a running warp, may be simultaneously processed on one spin-draw machine roll system. Spacing between the threadlines is very close, particularly when the warp is helically wrapped on the processing rolls to increase residence time. Because of the close proximity of threadlines in the running warp, it is not uncommon for a single broken threadline to disrupt adjacent threadlines and in many instances to cause a complete breakdown of the entire warp. At modern high-speed processing rates and close threadline spacing this occurs in a fraction of a second. As a consequence, maintenance of multiple threadline operation in a continuous mode over an extended production run requires constant vigilance by a large number of skilled personnel.

Suction nozzles have been used to aspirate away broken threadlines and thus protect the running warps of textile spinning machines. While these nozzles have performed satisfactorily at low yarn speeds, they do not have the pulling power to rapidly and reliably capture, remove and hold a broken threadline at the high yarn speeds now in use. It is the object of this invention to provide an improved suction nozzle which is capable of picking up and aspirating away high-speed threadlines. The improved nozzle protects a running warp against interference from broken threadlines and prevents yarn processing roll wraps.

SUMMARY OF THE INVENTION

In an aspirating apparatus that includes a suction nozzle coupled to an elongated manifold having a source of suction connected at one end, the improvement comprising: said nozzle having a slot shaped intake passage in communication with an expansion chamber, said expansion chamber being in lengthwise communication with said manifold and said manifold having an orifice open to atmosphere located at its other end. Optionally, a flexible scraper blade may be used to improve the pickup efficiency of yarn from a moving roll.

DETAILED DESCRIPTION OF THE DRAWINGS

Figure 1:
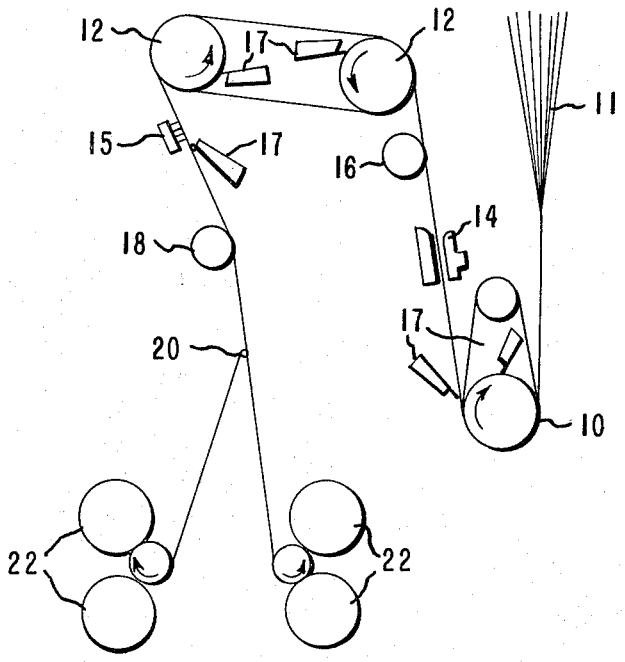
FIG. 1 is a schematic drawing of a typical highspeed spin-draw-winding machine showing the suction nozzles of this invention at various points in the process.

The embodiment chosen for purposes of illustration in FIG. 1 is a typical spin-draw-winding machine. The machine is equipped with a feed roll 10 and a pair of heated draw rolls 12 with a fluid draw jet 14 interposed between the feed roll and draw rolls. Finish rolls 16 and 18 lubricate the yarn prior to warp separating means (pins) 20, and winding on bobbins 22. Roll 10 receives the moving threadline warp 11 from upstream processing stations and in combination with rolls 12 and optionally jet 14 establishes a tensioned draw zone which determines the final denier of the yarn. In the particular arrangement shown, the tension is obtained by passing the threadlines around each roll pair a predetermined number of times so that yarn to roll slippage is eliminated. Warp 11 enters at one end of a roll and progressively moves across as a helically wrapped ribbon of parallel threadlines before exiting at the opposite end. Ordinarily, it is under such processing conditions that numerous threadline breakdowns occur, i.e., failure of one threadline will result in almost immediate entanglement in any of the various guide or moving surfaces and ultimately cause complete breakdown of the remainder of the warp.

A number of slot suction nozzles 17 of the present invention are shown in place. For example, feed roll 10 is protected by two nozzles, draw rolls 12 are each protected by a nozzle as are guide pins 15.

Figure 2:
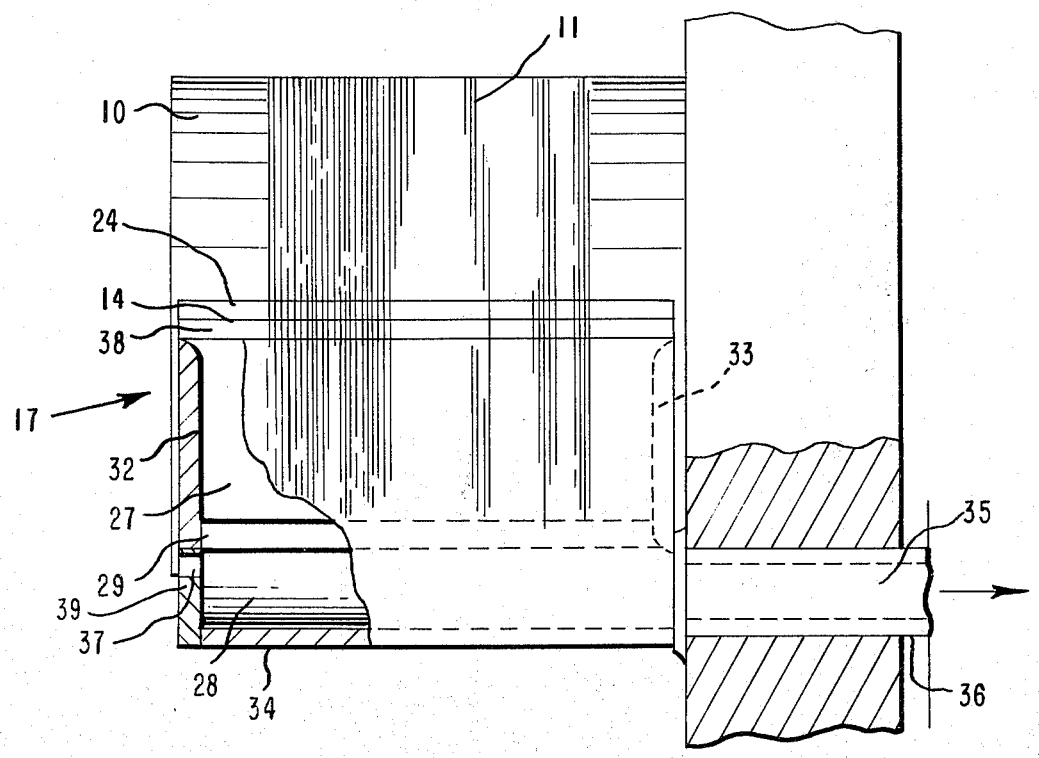
FIG. 2 is a plan view of a suction nozzle attached to an exhaust conduit and positioned proximate to a moving roll surface.
Figure 3:
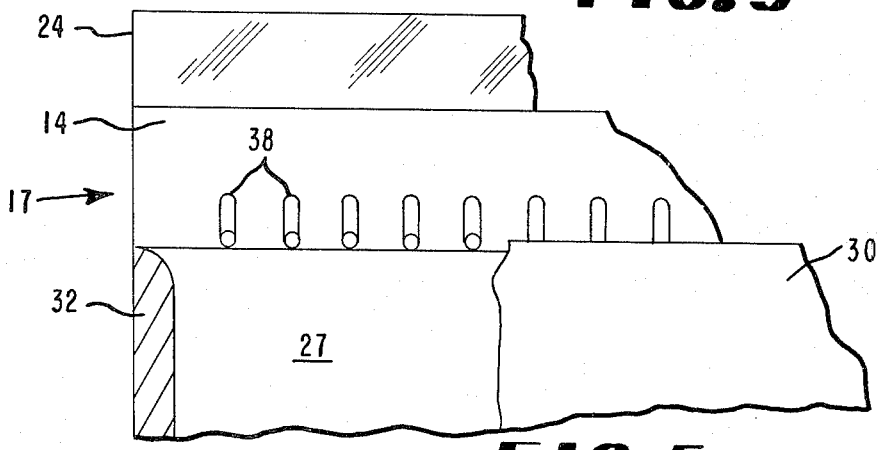
FIG. 3 is an enlarged view of a portion of the nozzle of FIG. 2 showing spaced yarn pegs at the slot entrance for handling large threadline warps.
Figure 4:
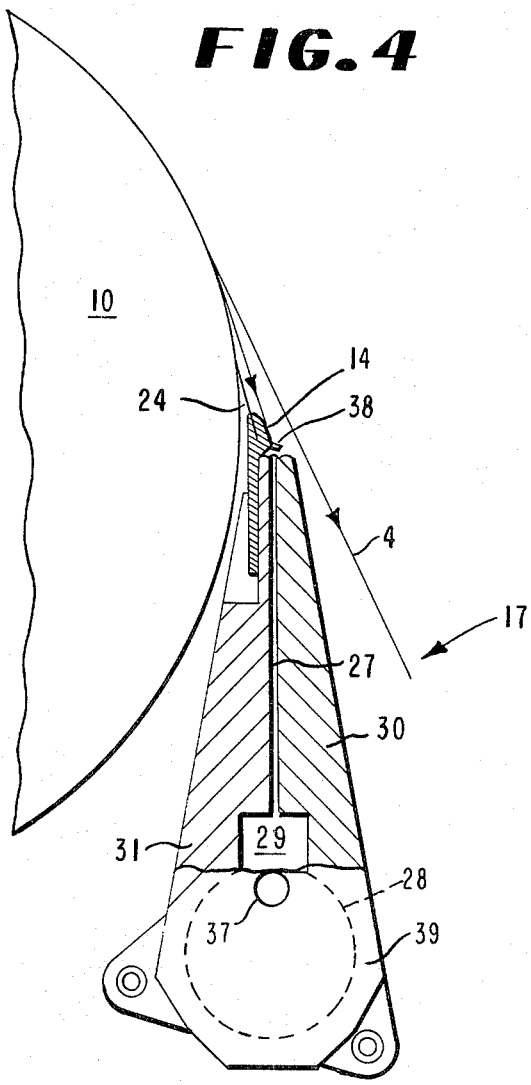
FIG. 4 is an end elevation partially in section of the suction nozzle of FIGS. 2 and 3.

In FIGS. 2–4 details of the preferred embodiment of the nozzle 17 are shown. A narrow, constant height slot passage 27 is open at one end and communicates at the other end with an elongated cylindrical-shaped manifold 28. At the interface between passage 27 and manifold 28 is a rectangular expansion chamber 29 which is in communication with a lengthwise or axial slot along the top of manifold 28. The passage 27 of nozzle 17 is defined by two flat plates 30, 31 and sidewalls 32, 33 which are integrally connected to a tubular housing 34 that defines manifold 28. At the open end or mouth of passage 27, plates 30, 31 are curved so that the mouth of the passage 27 has an outwardly flared opening which facilitates ingress of the broken threadlines and reduces fluid friction losses. An outlet 35 is located at one end of the tubular housing 34 at a right angle to the passage 27, and the axis of passage 27 intersects the axis of manifold 28. Outlet 35, in turn, is connected to a remote suction device and waste receptacle (not shown). Directly opposite of outlet 35, i.e., on the other end of tubular housing 34 is a cap 39 containing orifice 37. Expansion chamber 29 and orifice 37 function to prevent the thin sheet of high velocity fluid entering into manifold 28 from forming fluid vortices within the manifold. The vortex flow is undesirable since it causes a threadline to twist and excessively accumulate in the manifold region. Specifically, expansion chamber 29 serves to generate minor localized turbulent flow preventing the fluid sheet from attaching to the wall of manifold 28 which has been observed as a precursor to the formation of a vortex. Bleed orifice 37, on the other hand, assists in the development of highly desirable parallel fluid flow along the length of manifold 28 since this flow direction is generally at right angles to the flow in passage 27. As a consequence of the aforementioned nozzle configuration, there is produced a combined axial and cross flow action on the threadline which results in a significant improvement in tension capability amounting to almost seven times greater than in a comparable standard straight tube-type nozzle. Because of the high tension developed in the nozzle, an outboard threadline upon entering passage 27 will automatically shift diagonally toward outlet 35. In the process, it will cross under the remainder of the running yarn 11 and disrupt the running threadlines. To prevent the lateral displacement of retrieved broken threadlines a plurality of closely spaced guide pins 38 are located at the entrance to passage 27 (FIG. 3). These pins 38 are made of a suitable abrasion resistant polished material and are press fit into the top surface of deflector 14 at an oblique angle for minimum restriction of threadline entry. In nozzle embodiments not employing an integral deflector 14, an extension of plate 31 may be provided for retention of the pins. Thus, when a threadline breaks it is deflected into the nozzle 17 and maintained generally parallel to the warp. When desired, a flexible doctor blade 24 may be incorporated with the nozzle 17 as shown. The doctor blade is particularly preferred when capturing broken threadlines from a roll surface.

Figure 5:
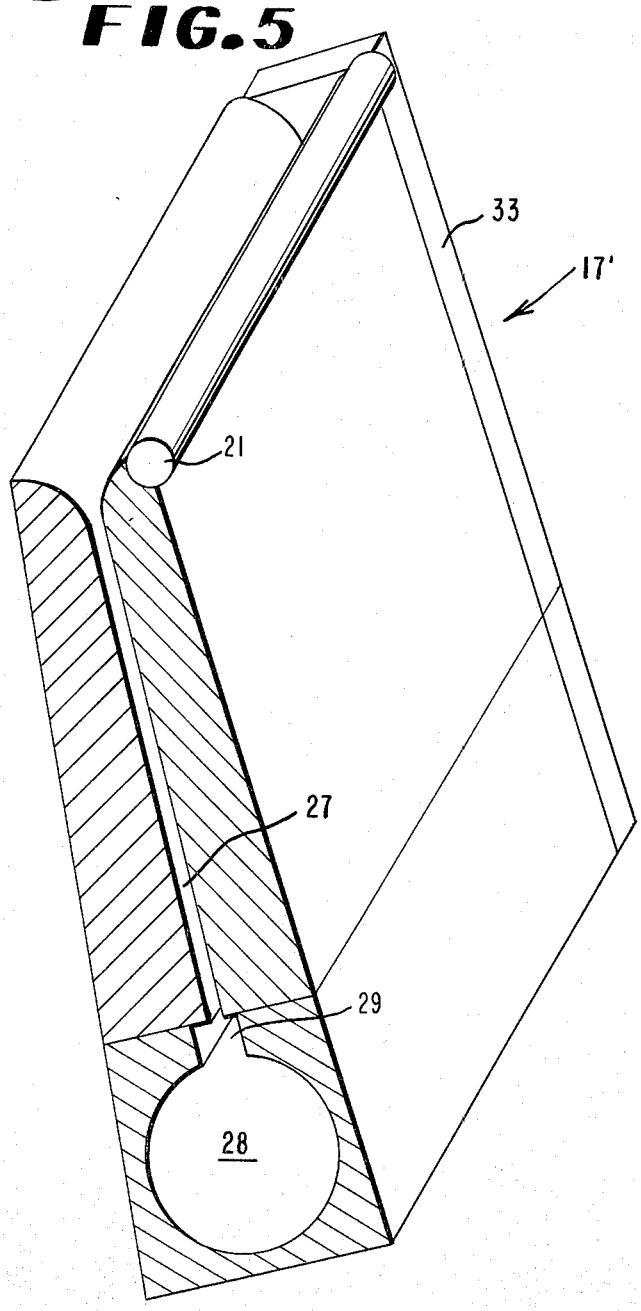
FIG. 5 is an alternative nozzle design featuring a pin to prevent threadline capture during momentary tension drops.

In FIGS. 2-4 nozzle 17 is shown equipped with a yarn deflector 14 and attached doctor blade 24. However, in certain circumstances only the nozzle may be satisfactory. For example, in FIG. 1, the nozzle 17 located adjacent stationary guide 15 serves to aspirate the threadline accidently broken during winding or at restringing and as a convenient depository for threadlines temporarily diverted during stringup and doff cycles. In place of deflector 14 is a circular support pin 21 (FIG. 5) which makes light contact with the running threadlines. Pin 21 serves as a spacer which maintains the threadlines a predetermined distance away from the high velocity fluid stream at the passage 27 entrance and thus prevents threadline capture during momentary tension drops.

The exceptional efficiency of these slot vacuum jets is related to two design parameters: the expansion chamber 29 and the bleed orifice 37. As mentioned previously the expansion chamber helps prevent vortex formation in the manifold 28. Vortex flow may cause a threadline to twist and accumulate in the manifold region. The bleed orifice 37 assists in the development of parallel fluid flow along the length of manifold 28. This flow leads to greatly increased pulling power of the jet.

The location of the bleed orifice 37 affects the efficiency of reducing vortexing and thereby the tension exerted on the yarn. The orifice may be located on the periphery of the end cap or in the center, but the periphery is preferred.

The optimum size for the bleed orifice 37 depends on the geometry of the remainder of the nozzle, the cross-sectional area of the slot opening 24, and the air flow in the system. For a particular nozzle having a cross-sectional slot area of 0.523 inch and at air flow rates of 90–150 ft.$^3$/min., a ratio of orifice area 37 to slot opening 24 of 0.1 to 0.7 gives best results.

What is claimed is:

1. In an aspirating apparatus that includes a suction nozzle coupled to an elongated manifold having a source of suction connected at one end, the improvement comprising: said nozzle having a slot shaped intake passage in continuous lengthwise communication with said manifold; and said manifold having an orifice continuously open to atmosphere located at its other end to assist in the development of parallel fluid flow along the length of the manifold.

2. The apparatus of claim 1, there being an expansion chamber between said slot shaped intake passage and said manifold, said expansion chamber having a rectangular cross section, said manifold having a round cross section.

* * * * *